US005655786A

United States Patent [19]

Raftogianis

[11] Patent Number: 5,655,786

[45] Date of Patent: Aug. 12, 1997

[54] SNOWBOARD ASSEMBLIES, FASTENERS, AND RELATED METHODS

[76] Inventor: Michael J. Raftogianis, 1550 S. 1400 East, Salt Lake City, Utah 84105

[21] Appl. No.: 398,204

[22] Filed: Mar. 2, 1995

[51] Int. Cl.[6] ..... A63C 5/03

[52] U.S. Cl. ..... 280/14.2; 280/611

[58] Field of Search ..... 280/611, 14.1, 280/14.2, 601; 411/929.1

[56] References Cited

U.S. PATENT DOCUMENTS

| | | | |
|---|---|---|---|
| 4,040,326 | 8/1977 | Breed | 411/929.1 |
| 5,221,105 | 6/1993 | Mayr et al. | 280/611 |
| 5,417,443 | 5/1995 | Blattner et al. | 250/611 |

*Primary Examiner*—Richard M. Camby

[57] ABSTRACT

A snowboard assembly is disclosed which comprises unions or connectors comprising male and female fasteners and a retaining coil interposed between the two to prevent inadvertent loosening or separation.

16 Claims, 2 Drawing Sheets

SNOWBOARD ASSEMBLIES, FASTENERS, AND RELATED METHODS

FIELD OF INVENTION

The present invention relates generally to snowboards and, more particularly, to novel snowboard assemblies, connectors, and fasteners by which the assemblies are reliably secured together and related methods.

Background

Snowboards are used to pursue a fairly recent form of recreation. Initially, the construction of snowboards was fairly basic and unsophisticated. Straps, for example, were used to hold the user's boots in position on the snowboard during use. Laminated and contoured snowboards were later developed and bindings in lieu of were provided to accommodate selective positioning of the boots in respect to the snowboard and to achieve a more secure and reliable connection between the two.

The connections between bindings and the snowboard in the past have been unreliable in that loosening frequently occurs. Such loosening of connections can result in separation of fasteners with the loss of one or more fasteners, which ends the snowboard outing for the day, unless spare fasteners are available. Loosening of fasteners comprising connections can create a periodic need to re-tighten fasteners, requiring that tools for such be carried by or otherwise available to the snowboarder. Also, such loosening can result in injury to the snowboarder and sometimes damage to the snowboard because fasteners comprising connections either come off or shift in position, causing the snowboarder to fall.

BRIEF SUMMARY AND OBJECTS OF THE INVENTION

In brief summary, the present invention overcomes or substantially alleviates prior art problems. Novel snowboard assemblies, and unique unions, connectors, and/or fasteners for snowboards are provided, as are related methods. Male fasteners are held reliably in female fasteners by a retaining lock interposed between the two.

With the foregoing in mind, it is a primary object of the present invention to overcome or substantially alleviate problems of the prior art.

It is another paramount object to provide novel snowboard assemblies and related methods.

It is a further object of significance to provide novel unions, connectors, and/or fasteners for snowboard assemblies and related methods.

Another valuable object is the provision of novel connectors, and related methods, for snowboards comprising male fasteners reliably held in female fasteners by a retaining lock.

These and other objects and features of the present invention will be apparent from the detailed description taken with reference to the accompanying drawings.

DETAILED DESCRIPTION OF THE ILLUSTRATED EMBODIMENT

Figure 1:
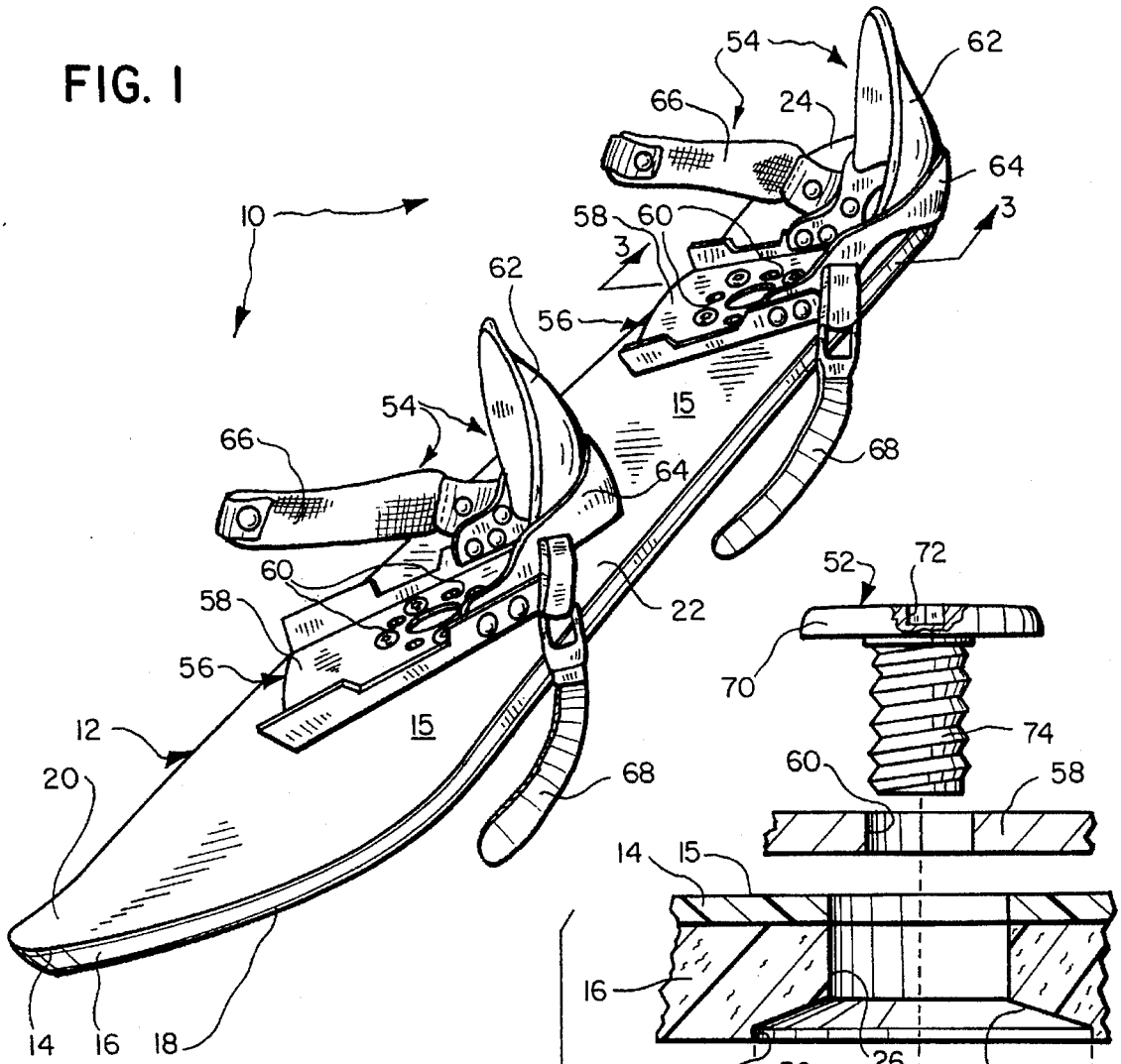
FIG. 1 is a perspective representation of an assembled snowboard embodying principles of the present invention.

Reference is now made to the drawings wherein like numerals are used to designate like parts throughout. FIG. 1 illustrates a snowboard assembly, generally designated 10. Snowboard assembly 10 is illustrated as comprising a laminated snowboard, generally designated 12, which is depicted as comprising a top laminated layer 14, an intermediate or central laminated layer 16, and a bottom laminated layer 18. Each layer is illustrated as comprising a suitable synthetic resinous material, although other materials could be used. Also, other forms of snowboards could be used in conjunction with the practice of principles of the present invention. The snowboard 12 is illustrated as being contoured so as to comprise an upwardly curved front tip 20, an arched central portion 22, and an upwardly turned trailing end 24.

Figure 2:
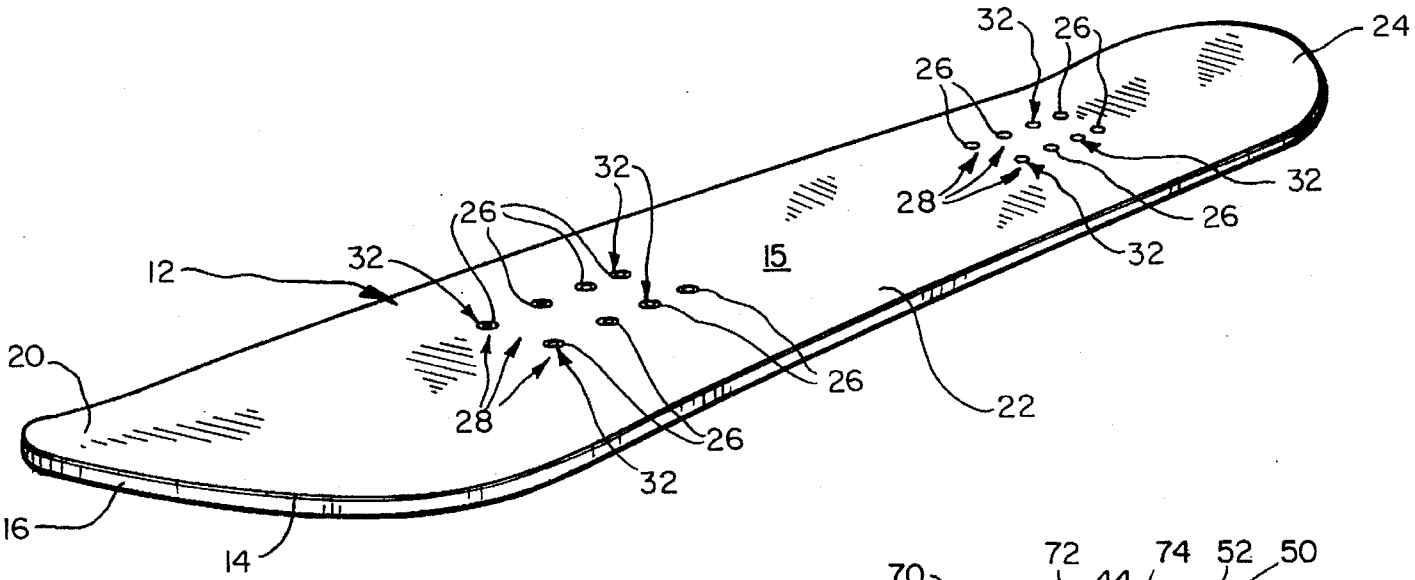
FIG. 2 is a perspective representation of the top two layers of the snowboard FIG. 1, with the bottom layer missing.

The laminated layers 14, 16, and 18 are bonded together in a conventional fashion. However, after bonding of layers 14 and 16 and prior to bonding of layer 18, a plurality of bores 26 are drilled or otherwise placed through laminated layers 14 and 16 so as to form an array of bores, generally designated 28 in FIG. 2.

Figure 3:
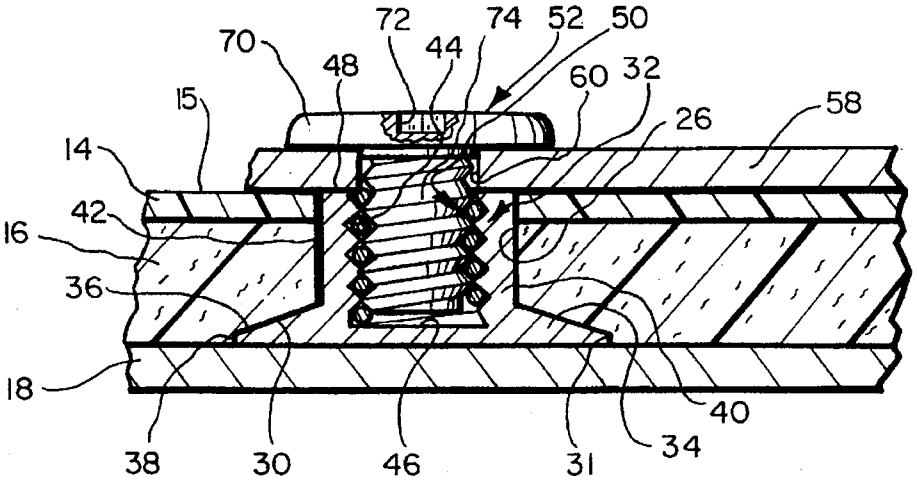
FIG. 3 is a cross-section taken along lines 3—3 of FIG. 1.

Each bore 26 is counterbored from the bottom thereof, at 30, in the lower portion of layer 16. Each associated bore 26 and counterbore 30 are sized and shaped to match the shape of a female fastener, generally designated 32. One female fastener 32 is inserted from the bottom up into each associated bore 26/counterbore 30, as illustrated in FIG. 3, before the bottom laminated layer 18 is conventionally secured to the central laminated layer 16. In this condition, as illustrated in FIG. 3, each female fastener 32 is trapped against removal from the bore-counterbore with which it is associated.

Each female fastener 32 is formed as one-piece and comprises a frusto-conical base 34 of solid material which comprises an annular exterior tapered surface 36 and an external peripheral base edge 38. Edge 38 is preferably knurled or serrated so that when tightly inserted into the associated counterbore 30, at surface 31, with or without bonding a non-rotatable relationship is created, which prevents the female fastener 32 from turning within the associated bore-counterbore 26/30.

Base 34 merges as one piece with an upwardly-directed annular boss 40. Boss 40 comprises a smooth cylindrical exterior surface 42. Boss 40 comprises an internal threaded generally cylindrical surface 44, which merges with an internal flat base surface 46 illustrated as being disposed internally within the frusto-conical base 34. The boss 40 comprises an upper flat edge surface 48 which, in the assembled condition, is illustrated as being flush with top surface 15 of the top laminated layer 14.

Figure 4:
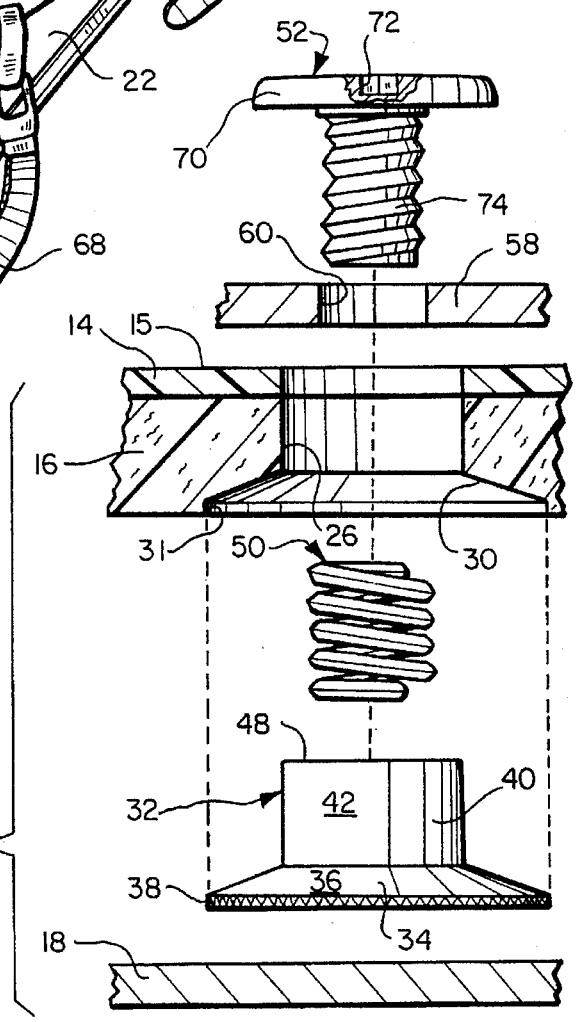
FIG. 4 is an exploded enlarged fragmentary cross-section of the subject matter of FIG. 3.

Either before placement of each female fastener 32 into its embedded relationship within the snowboard 12 or after such embedment, an anti-rotate lock insert, generally designated 50, is placed within the hollow threaded interior 44 of each female fastener 32. Each anti-rotate insert 50 is illustrated as being in the form of a hollow helical coil, one acceptable shape for which is illustrated in FIG. 4 in an unstressed, at rest state. The helical turns of the coil 50 are illustrated as being slightly separated or spaced one from the next. The coil 50 may be formed of any suitable material, stainless steel, aluminum, and high strength, high molecular weight synthetic resinous material being satisfactory.

Similarly, each female fastener 32 may be formed of any suitable material, stainless steel, aluminum, and high strength, high molecular weight synthetic resinous material being satisfactory.

The outside or maximum diameter of anti-rotate locking coil 50 is preferably slightly greater than the throat diameter of the threads at surface 44 within the hollow of the associated boss 32 so that when the coil is inserted, a compression-fit relationship is created which holds the coiled lock 50 in position. The interior diameter of the locking coil 50 is selected to bindingly and compressively receive an associated male fastener, such as the one generally designated 52, as explained hereinafter.

It is to be appreciated that, in the illustrated configuration, only some of the female fasteners 32 embedded in the snowboard receive male fasteners 52 to thereby create connectors. The compression-fit relationship between any given female fastener 32 and its associated coiled lock 50 will hold the two together, with or without an inserted male fastener 52.

In the illustrated embodiment, with particular reference to FIG. 1, two binding mechanisms, each generally designated 54, are mounted at the top surface 15 of the top laminated layer 14 of the snowboard 12 using four male fasteners 52, selectively placed in four female fasteners 32 of each of the two arrays 28 of female fasteners 32. By selective placement of the two binding mechanisms 54 in desired positions, at the top surface 15 of the snowboard 12, the snowboarder is able to achieve an orientation by which his talents can best be exploited on the snowboard. Experienced snowboarders will typically place the two binding mechanisms in two somewhat different orientations, according to their preferences.

Each binding mechanism 54 conventionally comprises a boot-receiving metal or plastic channel 56, which comprises an array of apertures 60 centrally disposed in the base plate 58 of the boot-receiving channel 56. Four fasteners 52 pass through four of the apertures 60, of which there are more than four, to accomplish the above-mentioned desired selective orientation.

Each binding mechanism 54 further comprises a heel rest 62 and a heel reinforcement 64, respectively connected or otherwise associated with the adjacent boot-receiving channel 56. Similarly, a pair of straps 66 and 68 are carried by the heel reinforcement and comprise female and male interconnecting parts to accommodate joining and tightening of the two together around the arch of the boot of the snowboarder, in a conventional way.

While other male fasteners could be used, the fastener 52, illustrated best in FIGS. 3 and 4, is shown to comprise a head 70 in which is disposed a tool-receiving aperture 72. Recess 72 may be polygonal in its shape and adapted to receive an Allen wrench, or may be some other type of aperture or slotted configuration for receipt of a tool by which the fastener 52 is turned.

Head 70 merges as one piece with a threaded shaft 74, the root diameter of said threads being slightly greater than the hollow inside diameter of the associated locking coil 50. Thus, when the threaded shaft 74 of male fastener 52 is turned into the hollow of the associated locking coil 50, a compression-fit relationship is created by which the coil 50 is compressively interposed between threads 42 and the threads of shaft 74 so as to bind the three components together against inadvertent loosening and removal of the male fastener 52.

It is to be appreciated that principles of the present invention may be used to retro-fit used snowboard assemblies so as to remove prior connectors, the fasteners of which tend to loosen through use, and to replace the same with connectors comprising fasteners, which embody principles in accordance with the present invention.

The invention may be embodied in other specific forms without departing from the spirit of essential characteristics thereof. The present embodiment therefore to be considered in all respects as illustrative and are not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. An assembly comprising:

a snowboard comprising a top, a bottom, and a longitudinal axis;

the top of the snowboard comprising two arrays of a plurality of bores therein, each bore comprising a base surface below the top and above the bottom;

one discrete female fastener disposed in each bore juxtaposed the bore base thereof, each discrete female fastener being separate from the other discrete female fasteners and each comprise a threaded bore;

one binding mechanism secured at the top of the snowboard at each array of bores, each binding being disposed at an angle to the longitudinal axis;

threaded male fasteners passing through each binding into only some but not all of the female fasteners;

an anti-rotate coil engaged by the threads of each male fastener and the threads of the associated female fastener to hold the assembly against inadvertent separation.

2. A method of retrofitting a used snowboard assembly comprising the steps of:

removing threaded male fasteners from (a) threaded female fasteners, (b) a snowboard, and (c) snowboard binding mechanisms for removably holding a boot of a snowboarder to the snowboard;

inserting a coil into threaded engagement with at least some of the female fasteners from which the threaded male fasteners have been removed;

threading the prior or new male fasteners into threaded engagement with the coils within the threads of the female fastener to create a secured fastened relation which does not inadvertently separate as forces are imposed upon the binding mechanisms and the snowboard.

3. In a snowboard assembly:

a plurality of discrete threaded bore female fasteners comprising a predetermined number, the female fasteners being non-rotatably and separately embedded within an interior of a snowboard so that each threaded bore is exposed for access from a top of the snowboard, and several threaded male fasteners the number of which is less than the predetermined number of female fasteners, each male fastener comprising a thread shaft extending through a binding disposed at an acute angle to the snowboard and into the threaded bore of one of the individual female fasteners, an anti-rotate coil contiguously interposed between the respective threads of each pair of associated male and female fasteners so that the anti-rotate coil is compressively bound between contiguous threads of the bore and the contiguous threads of the shaft to prevent inadvertent loosening of any male fastener from its associated coil and female fastener.

4. A method of making a snowboard assembly comprising the steps of:

non-rotatably embedding several separate threaded bore female fasteners below each port in a top of the snowboard in an interior location within the snowboard so that the threaded bore is accessible only from the top of the snowboard;

inserting a coil into the threads of at least some of the bores;

placing apertured snowboard binding mechanisms at the top of the snowboard, each at a desired angle to the snowboard so that apertures in the binding mechanisms are aligned with only some of the top ports and embedded separate female fasteners;

extending a threaded male portion of a male fastener through the aligned sets of binding apertures, top ports, and embedded female fasteners, but not into any of the other female fasteners, and rotatably threading the threaded male portion into the coil of each set thereby securing only some of the female fastener at the bores thereof to the associated coil and threaded male portion.

5. In combination:

a snowboard comprising a top, the snowboard having several bores disposed therein, each bore comprising an opening at the top of the snowboard, a lower base surface portion located internally within the snowboard and a hollow portion disposed between the top opening and the lower base surface portion of the snowboard, the maximum transverse dimension of the hollow portion being smaller than the maximum transverse dimension of the base surface portion lower portion;

snowboard binding mechanisms each secured at an acute angle to the top of the snowboard;

threaded male connectors extending through apertures in each snowboard binding mechanism and into at least some of the bores in the snowboard, a female connector non-rotatably disposed within the bore of the snowboard into which each threaded male connector extends, each female connector comprising a hollow boss portion comprising internal threads, a coil bindingly interposed between the threads of the boss portion of each bore female connector and the threads of the associated male connector to secure the three together against inadvertent separation.

6. A combination according to claim 5 wherein each snowboard bore is sized and shaped so each contiguously matches the shape of the female connector.

7. A combination according to claim 5 wherein each female connector comprises a lower portion comprising an exterior tapered surface.

8. A combination according to claim 5 wherein the top of the snowboard comprises an exposed surface and each hollow boss portion comprises a top edge which is substantially flush with the exposed surface of the top of the snowboard.

9. A combination according to claim 5 wherein an exterior tapered portion is interposed between the base surface portion and the hollow portion of each snowboard bore.

10. A combination according to claim 5 whereto each coil is diametrally reduced in size when placed into the threads of the associated boss portion.

11. A combination according to claim 5 wherein the coil comprises spaced turns of a wound wire.

12. A combination according to claim 5 wherein the female connectors are non-rotatably disposed within the bores of the snowboard by a bonding agent.

13. A method of making a snowboard assembly comprising the steps of:

fabricating at least two arrays of bores which are each open at a top of a snowboard;

non-rotatably securing a separate female fastener in each bore of the snowboard so that a threaded bore in each female fastener is accessible from the top of the snowboard;

causing a retention coil to be placed compressively into the threads of each bore of at least some of the female fasteners;

placing spaced apertured snowboard bindings angular in respect to and at the top of the snowboard, snowboard bindings being superimposed over spaced arrays of the snowboard bores, apertures in each binding being aligned with at least some of the snowboard bores;

extending threaded male fasteners respectively through at least some of the apertures in the bindings threading the threads of the male fasteners into the respective coils within the associated female fasteners against inadvertent separation.

14. A method according to claim 13 wherein the causing step comprises reducing the outside diameter of the coils to achieve a compression-fit relationship with the threaded bores of the associated female fasteners.

15. A method according to claim 13 further comprising the step of:

retainingly placing a non-apertured bottom layer of the snowboard immediately under the snowboard bores.

16. In a snowboard assembly:

a plurality of connectors interposed between a binding mechanism and a snowboard, at least one of the connectors comprising a discrete female fastener having an enlarged base portion and an extension portion, the extension portion comprising a hollow interior, each female fastener being embedded in a bore formed in the snowboard and exposed for access at the top of the snowboard, the bore having a counterbore formed at the end of the bore opposite the top of the snowboard, a separate anti-rotate lock carried within the hollow interior of the extension portion of the associated discrete female fastener and a male fastener an end of which extends within and engages the anti-rotate lock so that the anti-rotate lock is bound between the hollow interior and the end to prevent inadvertent loosening of the male fastener from the female fastener.

* * * * *